United States Patent [19]

Nakagima et al.

[11] 4,196,933

[45] Apr. 8, 1980

[54] SAFETY WALL CUTTING THROUGH METHOD EMPLOYED IN LONG WALL MINING

[75] Inventors: Shigeo Nakagima; Ken Takahashi; Hajime Endo, all of Tokyo, Japan

[73] Assignee: Taiheiyo Engineering Inc., Tokyo, Japan

[21] Appl. No.: 917,810

[22] Filed: Jun. 22, 1978

[30] Foreign Application Priority Data

Nov. 4, 1977 [JP] Japan ..... 52-132307

[51] Int. Cl.[2] ..... E21C 41/02

[52] U.S. Cl. ..... 299/11; 299/12; 299/19

[58] Field of Search ..... 299/11, 12, 18, 19, 299/42-46, 51-54

[56] References Cited

U.S. PATENT DOCUMENTS 3,999,804 12/1976 Simpson ..... 299/11

FOREIGN PATENT DOCUMENTS 1060489 3/1967 United Kingdom ..... 299/43

*Primary Examiner*—Ernest R. Purser

*Attorney, Agent, or Firm*—Thomas R. Morrison

[57] ABSTRACT

A safety wall treating method employed in the coal mining operation at the long wall face of a coal mine comprises shearing the long wall face leaving safety wall(s) at one or both side(s) of the face but shearing through the safety wall(s) at regular intervals to form intake or exhaust openings communicating with intake or exhaust tunnels.

5 Claims, 5 Drawing Figures

SAFETY WALL CUTTING THROUGH METHOD EMPLOYED IN LONG WALL MINING

BACKGROUND OF THE INVENTION

The present invention relates to an improvement of the coal mining method at the long wall face of coal mine and an improvement in a coal mining machine employed to attain this improved coal mining method.

As shown in FIG. 1, the conventional coal mining methods, particularly, of moving-back type employed at the long wall face of coal mine comprise previously providing an intake tunnel (A) and an exhaust tunnel (B) at the both sides of coal bed, arranging the coal mining machine such as a ranging drum shearer and the groups of self-advancing supports in front of the long wall face, and operating the combination of shearer (D) and supports (E) to shear the long wall face in the direction shown by an arrow. When the operational condition is bad, for example, the roof of mine is likely to fall, both sides of long wall face which abut the intake and exhaust tunnels, respectively, are likely to partially break down during the coal mining operation, hindering the intake and exhaust of air to and from the long wall face, so that the coal mining operation must be stopped, thereby lowering the coal mining efficiency. This difficulty has previously been avoided by shearing the long wall face to leave safety walls, which are one to three meters wide, at both sides of the long wall face, or by arranging props by manual labor at both sides of the long wall face. However, in the former case, the operation site is closed by the safety walls from the intake and exhaust tunnels and, therefore, the safety walls must be partially broken by manual labor using the drill and dynamite to form openings communicating the operation site with the intake and exhaust tunnels. In the latter case, too, the props must be shifted by manual labor. Since the inhaling of floating dusty materials by the laborers must be avoided for sanitary reasons, these operations of partially breaking the safety walls, particularly, the one left at the exhaust side of long wall face and of shifting the props in both cases make it necessary to temporarily stop the coal mining operation, thus substantially lowering the coal mining efficiency.

SUMMARY OF THE INVENTION

It is, therefore, a primary object of present invention to provide a coal mining method comprising shearing the long wall face of coal mine to leave safety coal pillars at the intake and exhaust sides of face.

Another object of present invention is to provide a coal mining machine suitable for attaining said coal mining method.

These and other objects as well as the merits of present invention will be apparent from the following detailed description with reference to the accompanying drawings.

DETAILED DESCRIPTION OF THE PREFERRED EMBODIMENT

Figure 1:
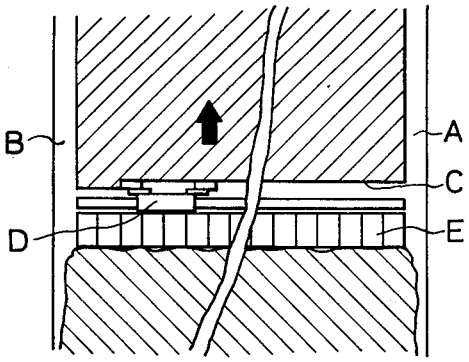
FIG.1 PRIOR ART
FIG. 1 shows how the conventional coal mining method is performed.
Figure 2:
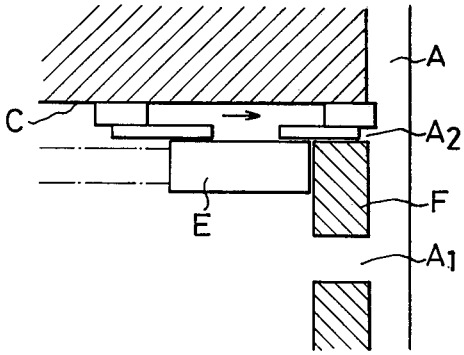
FIG. 2 shows how the coal mining method of the present invention is performed.

FIG. 2 shows how the coal mining method of present invention is performed, in which the long wall face is being sheared to leave safety coal pillars (F) at the intake side of face. Namely, said coal mining method comprises causing the coal mining machine (D) to shear the long wall face in such a manner that safety coal pillars are left at the both sides of face, in other words, that an intake or exhaust opening is formed between the safety coal pillar and its adjacent one. Different from the conventional ones, the coal mining machine of present invention allows the coal mining machine (D) to shear the long wall face to leave or not to leave safety coal pillars at the both sides of face, eleminating the operations of partially breaking the safety walls and of shifting the props, so that the coal mining machine can be used to the utmost extent to enhance the coal mining efficiency.

Figure 3:
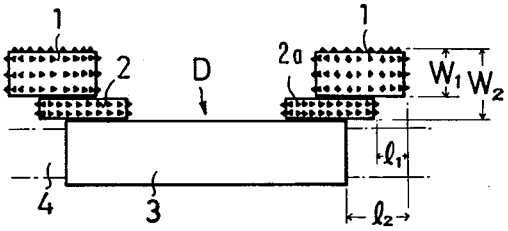
FIG. 3 is a plane view showing an embodiment of a coal mining machine employed to attain the coal mining method of present invention.
Figure 4:
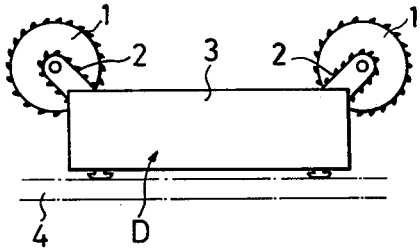
FIG. 4 is an elevational view showing the machine shown in FIG. 3.

FIGS. 3 and 4 are plane and elevational views showing a coal mining machine suitable for attaining the coal mining method of present invention. This coal mining machine is called a double ranging drum shearer, but is different from the conventional ones in that the arms 2, each of which holds a shearing drum 1 and through which driving force is transmitted to the shearing drums 1, are provided with shearing blades 2*a*. The conventional shearers whose arms 2 are not provided with the shearing blades can shear the safety wall only to the depth of $l_1$ because the shearing drum 1 is obstructed by the arm 2. Since the width of the safety wall is generally larger than $l_1$, it is impossible that the conventional shearers shear through the safety wall to form an intake or exhaust opening communicating with the intake or exhaust tunnel. In contrast, the shearer of present invention whose arms 2 are provided with the shearing blades can shear the safety wall to the depth of $l_2$. Therefore, when the width of safety wall is smaller than $L_2$, it is easy that the shearer of present invention shears through the safety wall to form an intake or exhaust opening communicating with the intake or exhaust tunnel.

The shearer (D) shown in FIGS. 3 and 4 comprises a body 3, arms 2 attached to the both ends of body 3, respectively, and shearing drums 1 attached through the respective arms 2 to the body. In addition to the shearer (D), the one having a body provided with a single shearing drum may be used in the present invention. And the one having a body provided with arms, to each of which a sub-arm is attached and a pair of shearing drums are attached through the sub-arm, may also be used in the present invention. However, in the latter case, shearing capacity must be added to the main and sub-arms, respectively.

The shearer (D) including the above-mentioned ones shears the long wall face in such a manner that the body 3 is moved in the left and right direction on a conveyor 4 arranged in front of and parallel to the long wall face. The movement of shearer (D) toward the long wall face is carried out by moving the conveyor 4 toward the face by means of a shifter (not shown), but the heavy weight of shearer makes it difficult to move the shearer in the back and forward direction. Therefore, the manner in which the conventional shearers whose arms are not provided with the shearing blades are moved only by the length of $W_2$–$W_1$ in FIG. 3 in the back and forward direction so as to eliminate the obstruction of arms and to shear through the safety walls is not useful.

Figure 5:
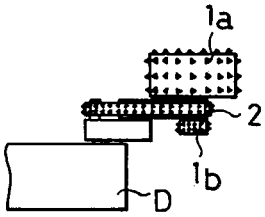
FIG. 5 is a plane view showing another embodiment of the machine.

FIG. 5 shows another embodiment of coal mining machine, in which main and sub-shearing drums 1*a* and 1*b* are attached to an arm 2 with the arm 2 located therebetween and the arm 2 itself is provided with a jib chain having shearing capacity. The idea of this embodiment can be applied to the shearer having main and sub-arms and a pair of shearing drums attached to the body through the respective main and sub-arms.

As described above, the coal mining method of the present invention allows the coal mining machine to shear the long wall face leaving the safety walls at the both sides of face but shearing through the safety walls at regular intervals to form intake or exhaust openings communicating with the intake or exhaust tunnel, so that the coal mining efficiency can be substantially enhanced as compared with the conventional methods making it unnecessary for any laborers to be engaged in manual labor.

What is claimed is:

1. In the coal mining method employed at a long wall face of a coal mine comprising shearing said long wall face with a drum shearer having at least one shearing drum having a horizontal drum axis leaving a safety wall at at least one side of said face so as to prevent the side of said face which abuts at least one of an intake and an exhaust tunnel from breaking down, a safety wall treating method wherein the improvement comprises drum shearing said long wall face leaving said safety wall and extending said shearing drum through said safety wall a greater distance than the radius of said shearing drum at regular intervals to enter at least one of said tunnels and thereby to form intake or exhaust openings communicating with at least one of said tunnels leaving a plurality of safety pillars therebetween.

2. A coal mining method according to claim 1 wherein said shearing drum is supported on an arm, said arm having additional shearing means and said step of extending said shearing drum through said safety wall includes shearing said safety wall with said shearing drum and said additional shearing means.

3. A coal mining method according to claim 2 wherein said shearing drum includes a main shearing drum and a subshearing drum and said step of extending said shearing drum through said safety wall further includes shearing said safety wall with said sub-shearing drum.

4. A coal mining method according to claim 3 further comprising locating said shearing drum and said sub-shearing drum on opposite sides of said arm.

5. A coal mining method according to claim 2 further comprising moving said arm back and forth relative to said drum shearer.

* * * * *